United States Patent [19]

Zehnder

[11] 4,130,038

[45] Dec. 19, 1978

[54] THREAD PARTING DEVICE FOR TEXTILE MACHINES

[75] Inventor: Ulrich Zehnder, Einsiedeln, Switzerland

[73] Assignee: Maschinenfabrik Schweiter AG, Horgen, Switzerland

[21] Appl. No.: 808,093

[22] Filed: Jun. 20, 1977

[30] Foreign Application Priority Data

Jul. 22, 1976 [CH] Switzerland ..... 9432/76

[51] Int. Cl.[2] ..... B26D 7/02

[52] U.S. Cl. ..... 83/175; 83/382; 83/389; 83/456

[58] Field of Search ..... 83/175, 382, 389, 456, 83/459, 460; 57/175

[56] References Cited

U.S. PATENT DOCUMENTS 3,533,616 10/1970 Bettenhausen ..... 83/175 X 3,894,459 7/1975 Deppe et al. ..... 83/382 X 4,051,756 10/1977 Bognar ..... 83/389

*Primary Examiner*—J. M. Meister

*Attorney, Agent, or Firm*—Flynn & Frishauf

[57] ABSTRACT

The device includes a fixed separating member with two mutually parallel thread guide plates spaced from one another and a cutting body movable toward the fixed member and operable by a textile machine. The cutting body includes two clamping shanks, which in the course of a cutting motion slide against the outer surfaces of the guide plates with a predetermined contact pressure in order to tension a thread guided crosswise over the guide plates. The cutting body also includes a blade so arranged between and parallel to the clamping shanks that in the direction of the cutting motion its cutting edge lies behind the clamping edges of the clamping shanks.

7 Claims, 2 Drawing Figures

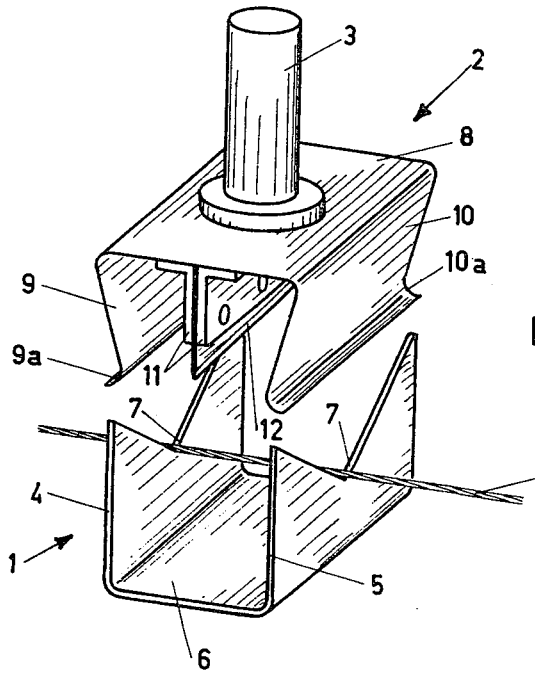
Fig. 1
Fig. 2
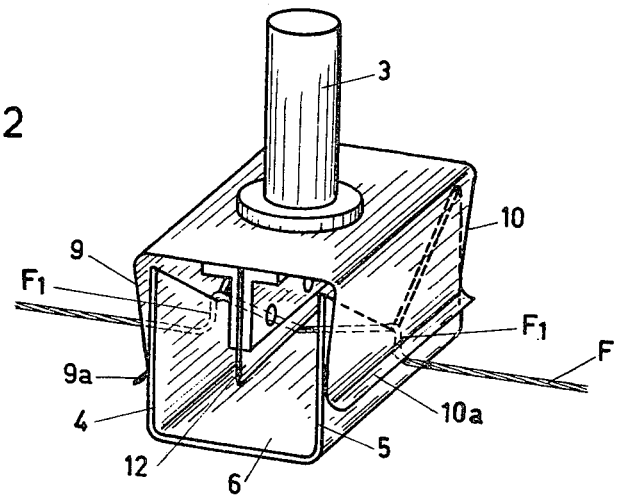

THREAD PARTING DEVICE FOR TEXTILE MACHINES

BACKGROUND OF THE INVENTION

The present invention relates to a thread parting device for textile machines, with a relatively fixed separating member and with a cutting member which is movable toward the fixed separating member, is operable by means of the textile machine, and comprises a cutting edge.

Thread parting devices have a very large field of application for textile machines, and occurr in such machines in very large numbers; for example, for parting the drag thread in pile preparation; in thread cleaners; in looms for parting the thuttle thread; etc., to name just a few areas of use.

Such thread parting devices exist in a relatively large number of distinct constructions, which however all work on the scissors principle with two opposing cutting edges moving toward each other, or on the chisel-anvil principle. As is known, all these constructions are very sensitive to wear and require regular and costly attention in order to avoid sensitive disturbances as a result of impaired cutting capability.

It is an object of the present invention to provide a thread parting device which operates with practically no wear and does so for an extended period of time, permitting always a proper parting.

SUMMARY OF THE INVENTION

This is achieved in accordance with the invention in that the fixed separating member comprises two mutually parallel and mutually spaced thread guide plates and the cutting member comprises a U-shaped thread tensioning bow with spring clamping shanks, which spring clamping shanks are in the cutting movement of the device slidable against the side surfaces of the thread guide plates with a predetermined contact pressure to tension a thread guided crosswise over the thread guide plates, and whereby a blade is arranged on the cutting member between the spring clamping shanks and parallel to them, the cutting edge lying in the cutting direction of the cutting body behind the clamping cheeks of the spring clamping shanks.

By these measures, it is now possible to leave the hitherto customary wear-intensive functioning principles of an opposing cutting edge or anvil, and to achieve a quasi-suspension parting, in which the thread itself is first tightly tensioned and then cut under its own tension. Even if hereby the cutting edge should wear somewhat after an extended time, the thread is stretched so between the clamping points upon the impact of the blade, that the perhaps incompletely cut thread will tear at the cutting point.

The thread parting device can in this way be comparatively very simply designed, and so produced at a relatively low cost. For this it is expedient for the fixed separating member to be a U-shaped body whose shanks form the thread guide plates.

It is further expedient for proper thread guiding that the thread guide plates feature at least one open edged groove.

For a sure, but non-damaging clamping and tensioning of the thread, it is appropriate for the spring clamping shanks to grasp the thread guide plates from outside during the cutting movement and for the bottom edges of the clamping shanks, which form the clamping edges, to be bent upwards. It is further advantageous for the spring clamping shanks to be pre-set for the clamping pressure for a particular construction.

In order to prevent any contact of the cutting edge against a hard surface, it is adviseable that the arrangement have, however preferred, an operating means with a limited cutting movement.

An embodiment of the inventive subject matter will be explained as example hereafter, together with the drawing.

BRIEF DESCRIPTION OF THE DRAWING

There are shown:

FIG. 1 a thread parting device in accordance with the invention, presented in picture form, and FIG. 2 the arrangement in accordance with FIG. 1, in cutting position.

DESCRIPTION OF THE PREFERRED EMBODIMENT

The shown thread parting device comprises a relatively fixed separating member 1, such as for example one threaded or otherwise fastened to a housing frame or the like, and a cutting body 2 movable toward the former. This cutting body 2 is movable back and forth between the rest position shown in FIG. 1 and the cutting position shown in FIG. 2, for which the cutting body 2 can be guided into housing means not shown in further detail, and is connected by a control tap 3 with corresponding operating means, also not shown in further detail. For operating means there are conceived motor drives, electromagnets, hydraulic or pneumatic piston-cylinder systems, or mechanical rods and the like.

The fixed separating member 1 comprises two mutually parallel thread guide plates 4 and 5 spaced from each other, which are here formed by the shanks of a U-shaped body 6.

Each of these thread guide plates 4 and 5 features an open rim thread guide groove 7, in the bottom of which is stretched a thread F. The separating member 1 is preferably relatively stiff and made of a suitable metal or synthetic.

The cutting body 2 cooperating with this separating member 1 comprises a U-shaped thread tensioning bow 8 carried by drive tap 3, the shanks 9 and 10 of the bow 8 forming spring clamping shanks. For this purpose, the tension bow 8 is made from a spring steel band. However, other materials, such as synthetic, are also conceivable. As is apparent from the representation, the clamping shanks 9 and 10 are here pre-set toward the inside, and their bottom edges **9*a*, 10*a*, which form the clamping edges, are bent up outwardly. Between the spring clamping shanks 9 and 10 and parallel thereto, there is arranged a blade 12 toward the inside at the foot of the tensioning bow 8 between two pressure plates 11. Here the cutting edge of the blade 12 projects less far from the foot of the tension bow 8 than does the clamping edge 9*a* and 10*a*, by which the cutting edge therefore lies behind the cutting body 2** in the direction of the cutting motion.

Should the thread guided in the thread guide grooves 7 of the thread guide plates 4 now be parted for any reason, then the cutting member 2 is given a movement against the separating member 1, so that the thread parting device changes from its relative position of FIG. 1 to that of FIG. 2. The clamping edges **9*a* and 10*a*** of the clamping shanks 9 and 10 slide against the outer surfaces of the thread guide plates 4 and 5 with the pressure determined by the pre-setting.

The thread overlapping the thread guide plates 4 and 5 is pulled downward by the sliding clamping edges 9*a* and 10*a*, as shown by the sections F1 of FIG. 2, which then relatively strongly tensions the thread F between the thread guide plates 4 and 5, upon which in a further movement phase the cutting edge of the blade 12 parts this thread.

Stop means, not shown in further detail, limit thereby the cutting movement of the cutting body 2 in such a manner that there can be no contact of the cutting edge of the blade 12 with the foot of the U-shaped body 6.

After the cutting movement, the thread parting device returns to the position shown in FIG. 1.

It is readily apparent that the above-described thread parting device can be produced relatively simply and permits comparatively high numbers of cuts with practically no attention.

Naturally, a number of variations of embodiments are conceivable within the framework of the invention. For example, the cutting body may be fixed and the separating member movable, or both members may execute a movement.

I claim:

1. A thread parting device for textile machines, comprising:

a fixed, separating member, comprising two mutually parallel thread guide plates spaced from each other;

a cutting edge-containing cutting body movable toward said fixed separating member and operable by means of said textile machine, comprising a U-shaped thread tensioning bow having two spring clamping shanks which during the course of a cutting motion of said device are slideable against the outer surfaces of said thread guide plates with a predetermined contact pressure in order to tension a thread guided crosswise over the thread guide plates, and a blade so arranged on said cutting member between and parallel to said clamping shanks that in the direction of the cutting motion its cutting edge lies behind said clamping edges of said spring clamping shank.

2. The thread parting device of claim 1 wherein the fixed separating member is a U-shaped body whose shanks form the thread guide plates.

3. The thread parting device of claim 2 wherein the thread guide plates are formed with at least one open rim thread guide groove.

4. The thread parting device of claim 1 wherein the spring clamping shanks of the cutting member overlap the outer side of said thread guide plates in the course of a cutting motion.

5. The thread parting device of claim 4 wherein the bottom edge of said spring clamping shanks is bent upwards.

6. The thread parting device of claim 1 wherein said spring clamping shanks have a pre-set tension.

7. The thread parting device of claim 1 wherein means are provided for limited cutting motion of the device.

* * * * *